United States Patent [19]

Corzine

[11] 4,360,816

[45] Nov. 23, 1982

[54] PHASED ARRAY OF SIX LOG-PERIODIC DIPOLES

[75] Inventor: Robert G. Corzine, China Lake, Calif.

[73] Assignee: The United States of America as represented by the Secretary of the Navy, Washington, D.C.

[21] Appl. No.: 167,059

[22] Filed: Jul. 21, 1971

[51] Int. Cl.[3] ..... H01Q 11/10

[52] U.S. Cl. ..... 343/792.5; 343/802

[58] Field of Search ..... 343/792.5, 802

[56] References Cited

U.S. PATENT DOCUMENTS

| | | | |
|---|---|---|---|
| Re. 25,604 | 6/1964 | Greenberg | 343/792.5 X |
| 3,106,714 | 10/1963 | Minerva | 343/792.5 |
| 3,127,611 | 3/1964 | Du Hamel et al. | 343/792.5 |
| 3,543,277 | 11/1970 | Pullara | 343/792.5 |

*Primary Examiner*—Theodore M. Blum

*Attorney, Agent, or Firm*—R. F. Beers; W. T. Skeer

[57] ABSTRACT

A direction finding antenna for accurate direction finding over broad continuous frequency spectrums, independently of polarization, comprising a phased array of six log-periodic dipole antennas with loaded elements.

4 Claims, 10 Drawing Figures

PHASED ARRAY OF SIX LOG-PERIODIC DIPOLES

BACKGROUND OF THE INVENTION

The antenna structure of the present invention is intended to provide a means of accurately direction finding over broad, continuous, frequency spectrums. It is additionally intended that the antenna provide moderate gain, provide direction finding signals regardless of received signal polarization, be compatible with operation in side missile type radomes over broad frequency ranges, utilize a relatively simple phased array feed network and be inexpensive when manufactured in large quantities.

Although the antenna may be used for a wide variety of direction finding requirements, the antenna is especially applicable to the seeker requirements of an anti-radiation missile.

Reduced size log-permeable antennas in which selected elements are loaded to reduce the resonant frequency of the selected elements are not new, as exemplified by U.S. Pat. No. 3,543,277. However, the use of a uniformly tapered antenna structure wherein all of the elements are loaded in a constant manner, is new. As will be noted later, the purpose of the loading with this invention is to reduce the mutual coupling between the six log-periodic dipole antennas rather than to reduce the size.

Various configurations of cavity backed planar spirals, conical spirals and log-periodic dipole configurations have been utilized to date to achieve direction finding capability.

Multi-mode, cavity backed planar spirals require that absorbent filled cavities be included for milti-octave frequency coverage when using the antennas. The gain of the antenna is greatly reduced by the absorber. Also, since the lower frequency range to be received by the antenna determines the diameter of the antenna, it is required that the planar spiral be placed in a rearward position in the radome, making it particularly susceptible to radome internal reflections. For receiving signals of all polarizations, it is required that the spiral antenna be simultaneously excited from the center and the outer periphery. To do this over multi-octave bandwidths requires many spiral elements to eliminate undesired modes and therefore complex, expensive, feed networks. The fact that the relative phase of the sum and difference modes does not remain constant with changing frequency introduces additional feed network complexity, and loss of gain, for compensating the relative phase.

The conical spiral eliminates the backing cavity associated with the planar spiral and therefore has better gain. However, the compensation of the relative phase of the sum and difference modes is much more difficult than for the planar spirals. As with the planar spiral, reception of all polarizations requires simultaneous center and outer periphery feeding and the attendant feed network complexity. Additionally, the phase center of the sum is not coincidente with the phase center of the difference mode. This causes the relative phase of the sum and difference modes to vary as a function of the angle between the antenna boresight and the target. Complexity is introduced in compensating for this phenomena. The conical spiral functions fairly well within a radome since high frequencies radiate near the tip of the conical spiral and low frequencies toward the base of the cone. However, since the phase center of the difference mode is not as close to the tip of the cone as the sum mode, it is slightly more subject to radome internal reflections than the sum mode.

Interferometer arrays of planar spirals are not frequency independent and receive circular polarization of one sense only without complex feed network. Log-periodic dipole interferometers are linearly polarized. Conical spiral interferometers, when arrayed in a frequency independent manner, suffer aperture blockage and poor direction finding accuracy. Also, conical spiral interferometers receive circular polarization of one sense only without complexity. Phase sensing requires a minimum of three antenna elements for monopulse direction finding in two planes.

Amplitude sensing systems provide relatively poor direction finding accuracy. Measurement accuracy also requires component matching requirements.

DESCRIPTION OF THE PREFERRED EMBODIMENTS

Figure 1:
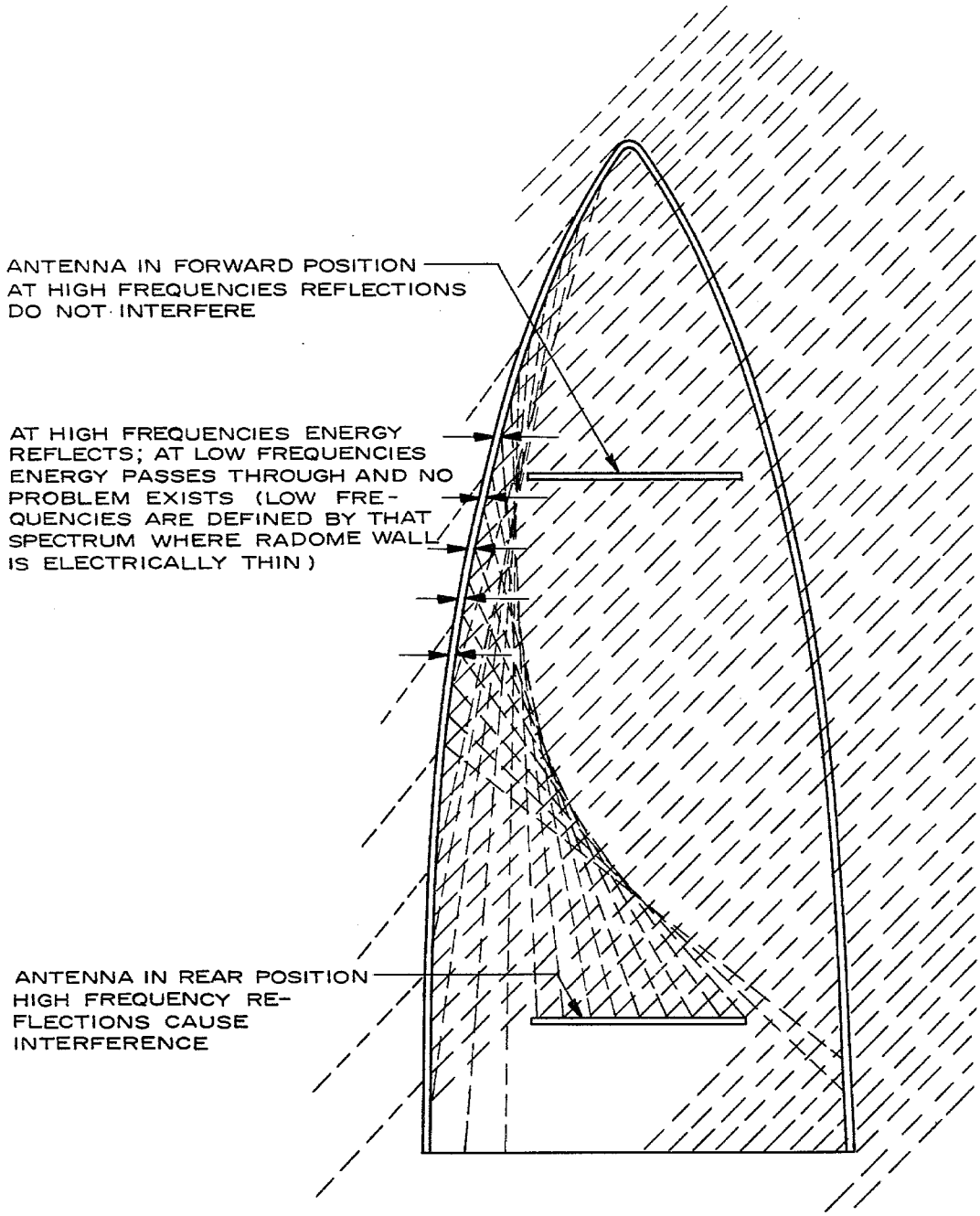
FIG. 1 illustrates a radome with attendant problems.

FIG. 1 illustrates a sample radome and the problems attendant conventional direction finding anti-radiation missile antenna positioning. The drawing is legended to indicate the problems.

Figure 2:
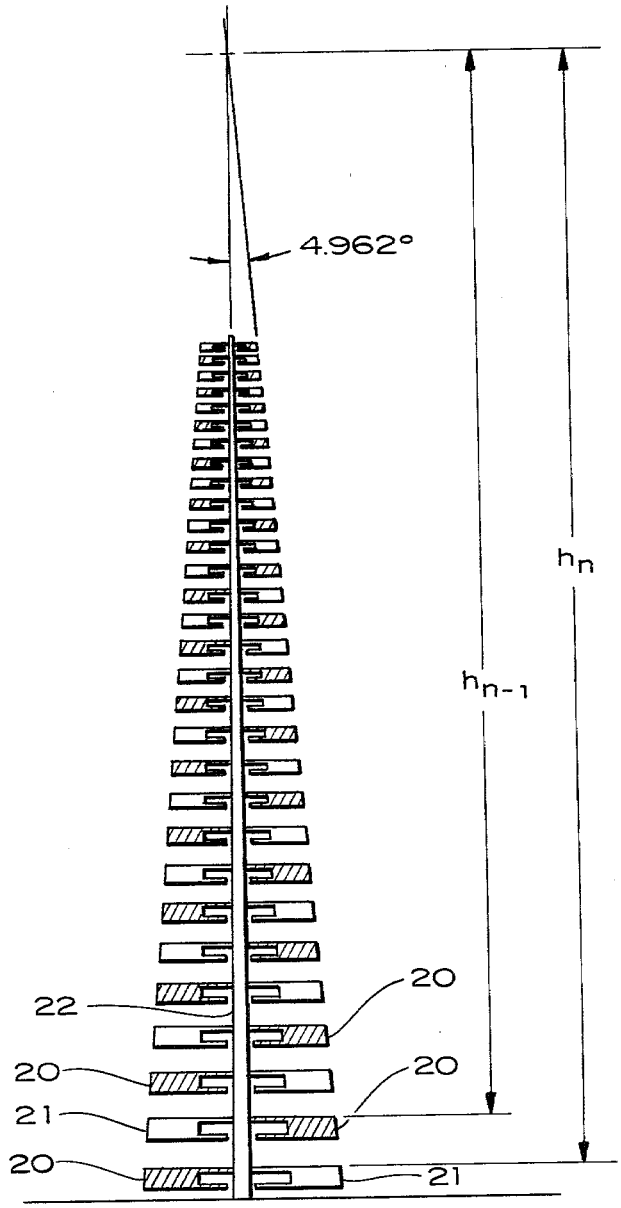
FIG. 2 illustrates an individual log-periodic dipole antenna.

FIG. 2 illustrates one individual dipole antenna and shows the positioning of the individual dipole elements thereon. Dipole elements 20 and 21 are printed on opposite sides of a conventional circuit board material. As shown in FIG. 2, the elements 20 and 21 progress in a stair-step like fashion up a center conductor 22 on opposite sides of the antenna. The antenna is uniformly tapered from the apex to the widest portion thereof. In the present instance the taper is 4.962°. The spacing between elements $$\tau = \frac{h_{n-1}}{h_n} = \frac{h_{n-2}}{h_{n-1}} = \frac{h_{n-3}}{h_{n-2}} = \ldots$$

Figure 3:
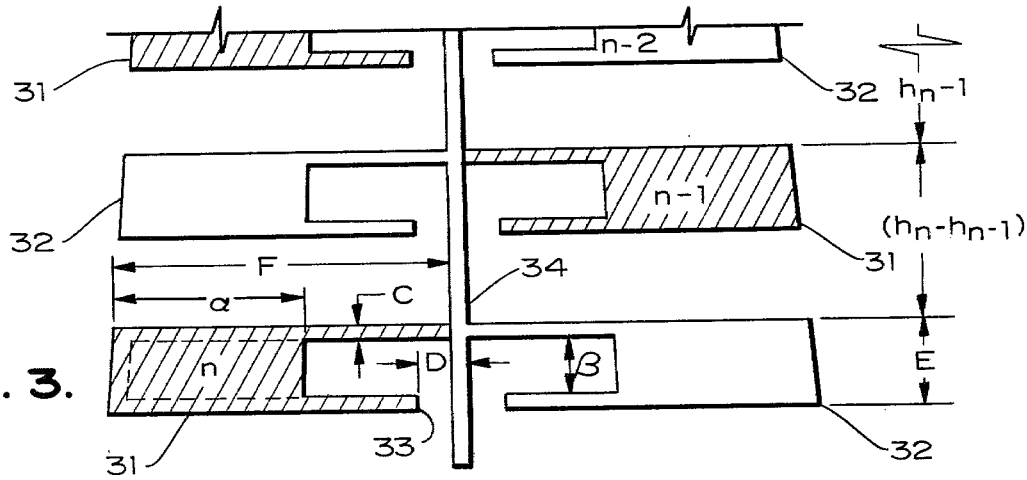
FIG. 3 is a partial log-periodic dipole antenna illustrating element design features.

FIG. 3 illustrates the design parameters involved in building an antenna wherein $\alpha=0.0844\lambda$, $\beta=0.0437\lambda$, $c=0.0066\lambda$, $d=0.0188\lambda$, $e=0.0375$, and $f=0.15\lambda$, wherein $\lambda$=wavelength at the operating frequency. Both dipole elements are shown in FIG. 3 however, again it is to be understood that alternating elements 31 and 32 are printed on the opposite sides of the circuit board material.

Figure 4:
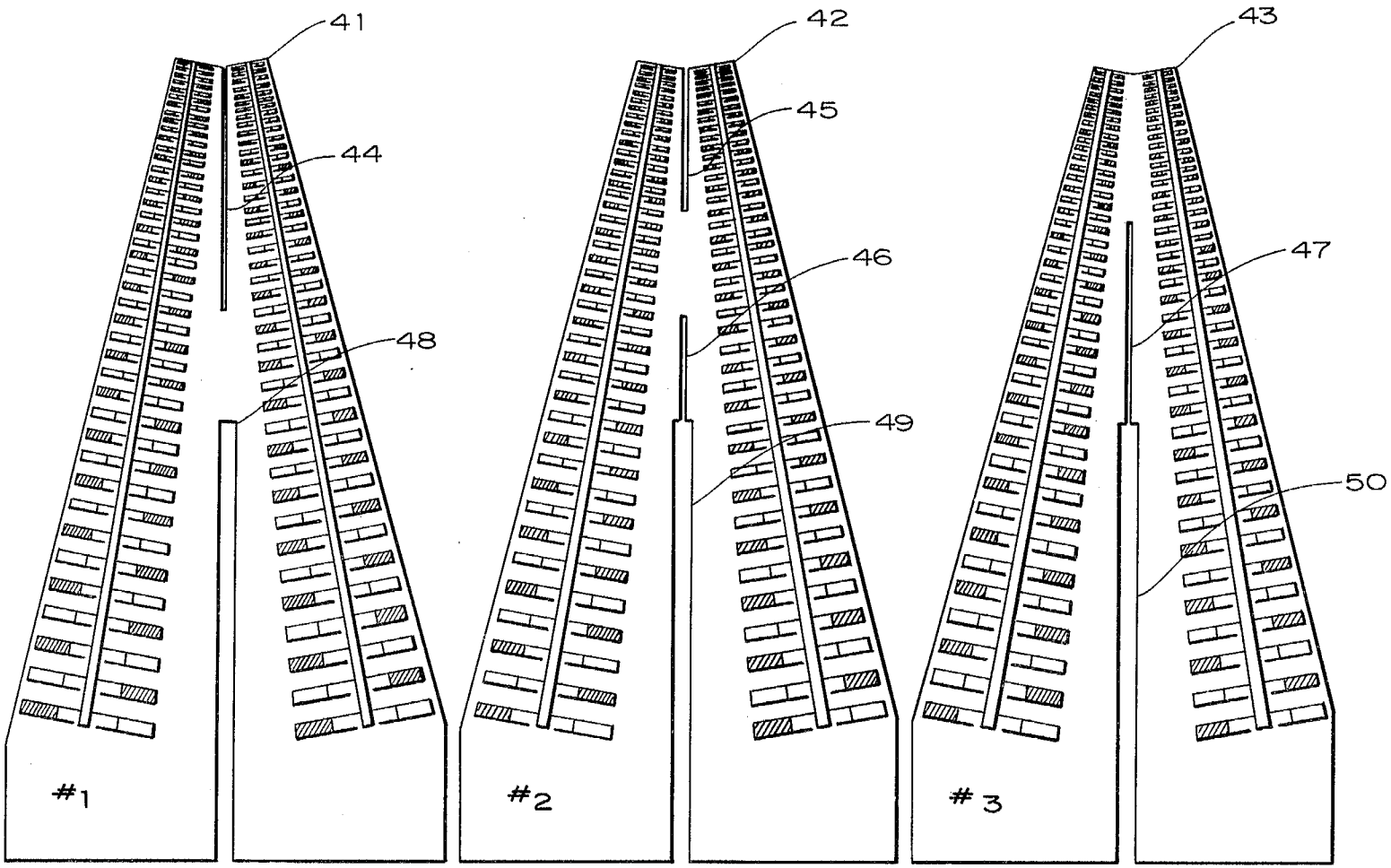
FIG. 4 illustrates the complete array of three pairs of log-periodic dipole antennas for a six element phased array.

FIG. 4 illustrates the construction and shape of the three circuit boards with the six antennas etched thereon. The circuit boards are designated 41, 42 and 43. Circuit board 41 is slotted as at 44; circuit board 42 slotted at 45 and 46 and circuit board element 43 slotted at 47 so that they may be interleaved to form the antenna structure of FIG. 5. The boards are also slotted as at 48, 49 and 50 to receive a reinforcing or mounting member shown in FIG. 6. This allows precision alignment of opposite log-periodic dipole antennas to be achieved which is important if high accuracy boresight characteristics are desired.

Figure 5:
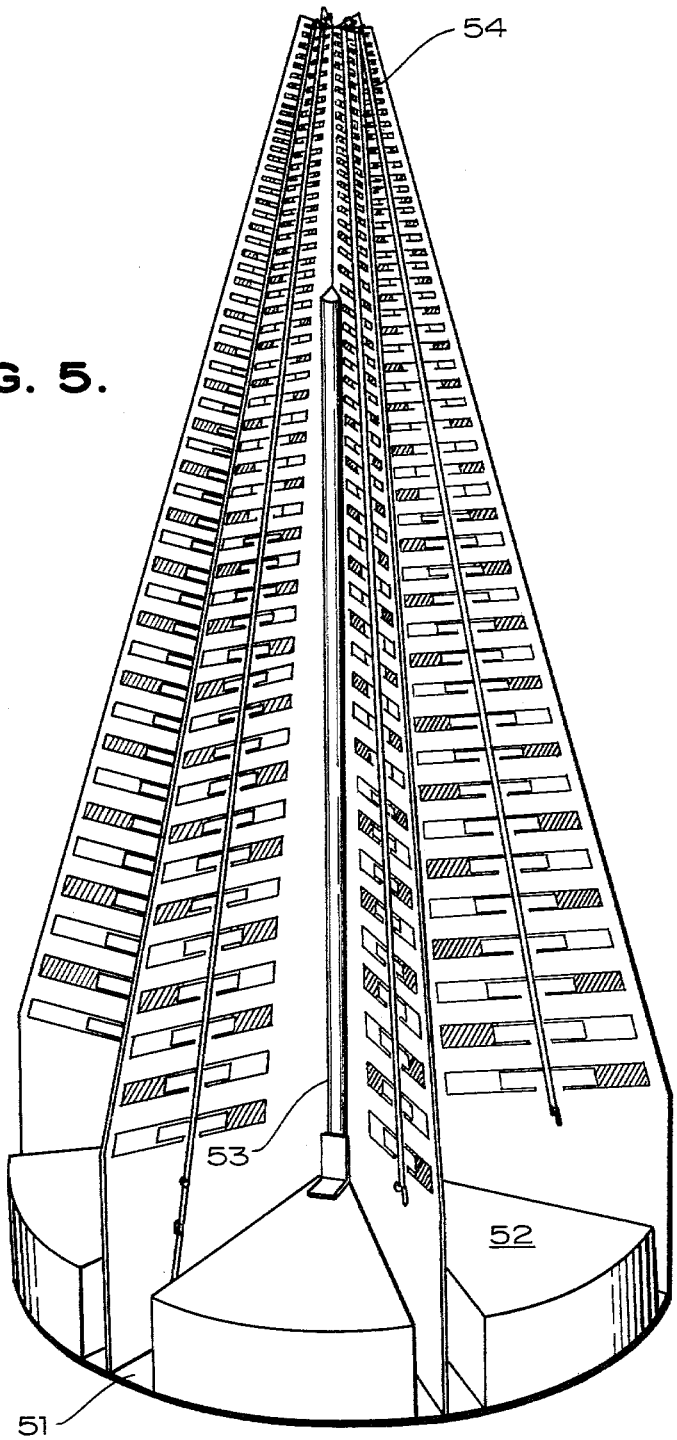
FIG. 5 illustrates an assembled array.
Figure 6:
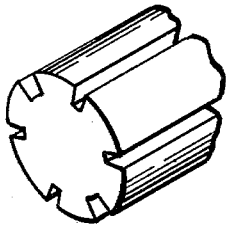
FIG. 6 is a partial illustration of a mounting member.
Figure 7:
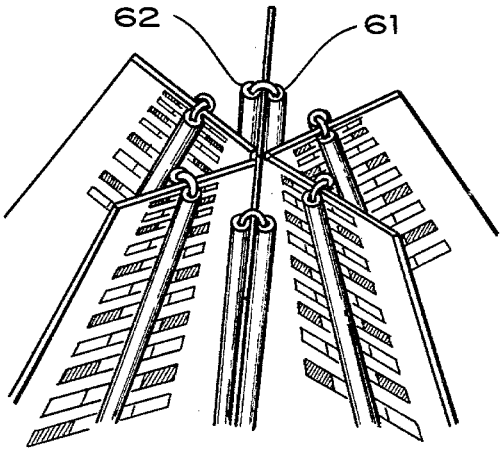
FIG. 7 is a top view illustrating the coaxial connections to the individual antennas.

In FIG. 5, the individual circuit board configurations of FIG. 4 are interleaved and mounted on a base 51. Pie shaped elements of an accoustic absorbing material known as Eccosorb are inserted as at 52 between the circuit board configurations at the base thereof. A reinforcing member 53, shown in FIG. 6, is positioned between the individual circuit board configurations for physical reinforcement. Running up the center of each of the arrays is one conductor of a coaxial cable as at 54 which is more completely illustrated in FIG. 7.

The individual elements, such as set forth in FIG. 2 are driven such that right and left elements lying in the same plane are alternately plus and minus. This is provided through the use of the coaxial arrangement shown in FIG. 7 wherein the outer conductor 61 of a "dummy" coax member is soldered to the center conductor 22 of FIG. 2 while the innerconductor 62 is soldered to the opposite side of the circuit board to the corresponding center of the array. In actuality, the center conductor of the coax is not used but rather a solid rod in that the diameters of the two feeds must be approximately the same for proper functioning. Through this arrangement, the dipole elements 20 and 21 of FIG. 2 will be alternately positive and negative as required for a proper radiation pattern.

Figure 8:
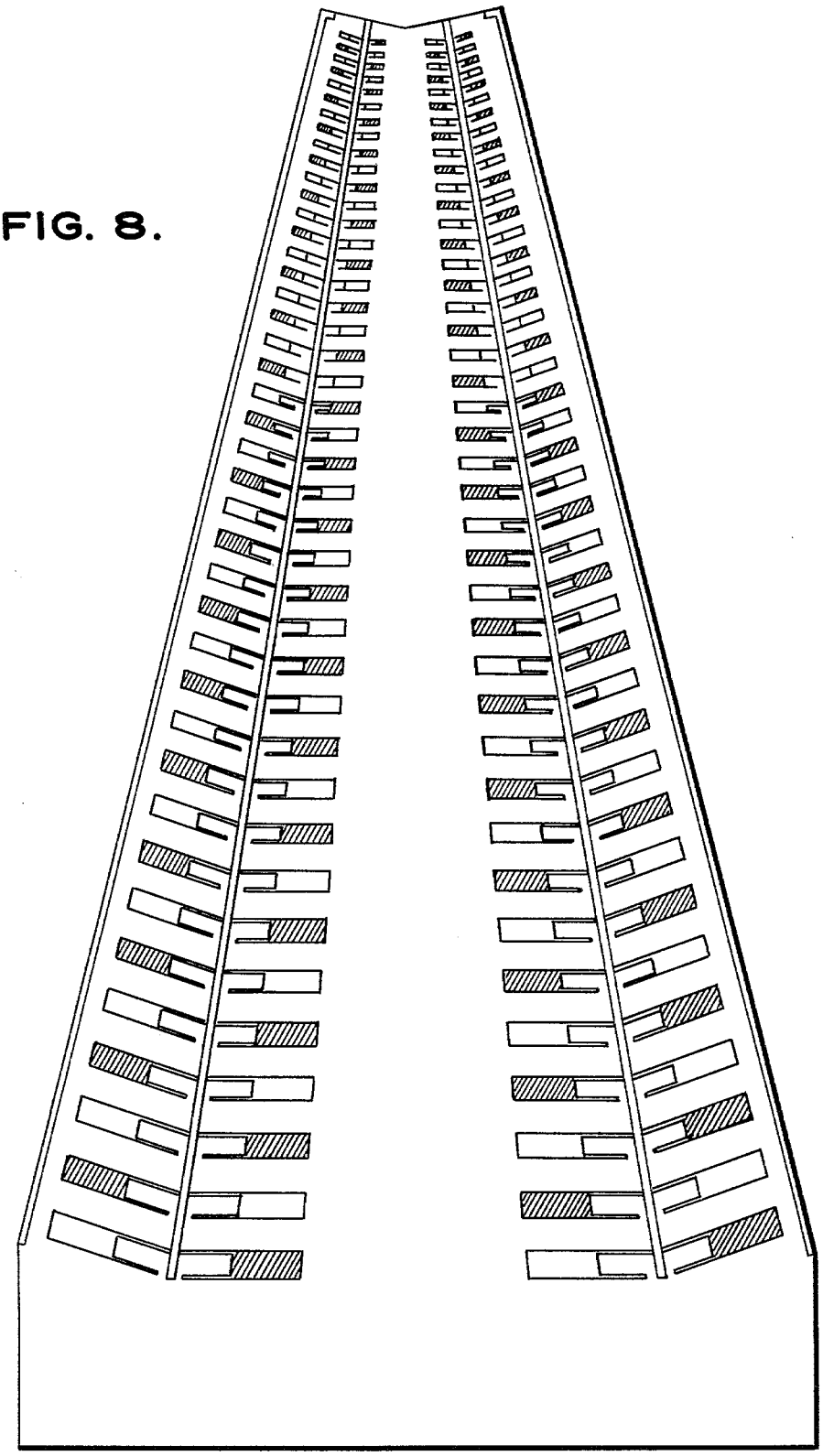
FIG. 8 illustrates another embodiment of the array.

FIG. 8 illustrates another embodiment of the invention wherein a further reduction in mutual coupling between the six log-periodic dipole antennas may be attained by slightly angling the individual elements in the direction of the apex of the antenna structure.

Figure 9:
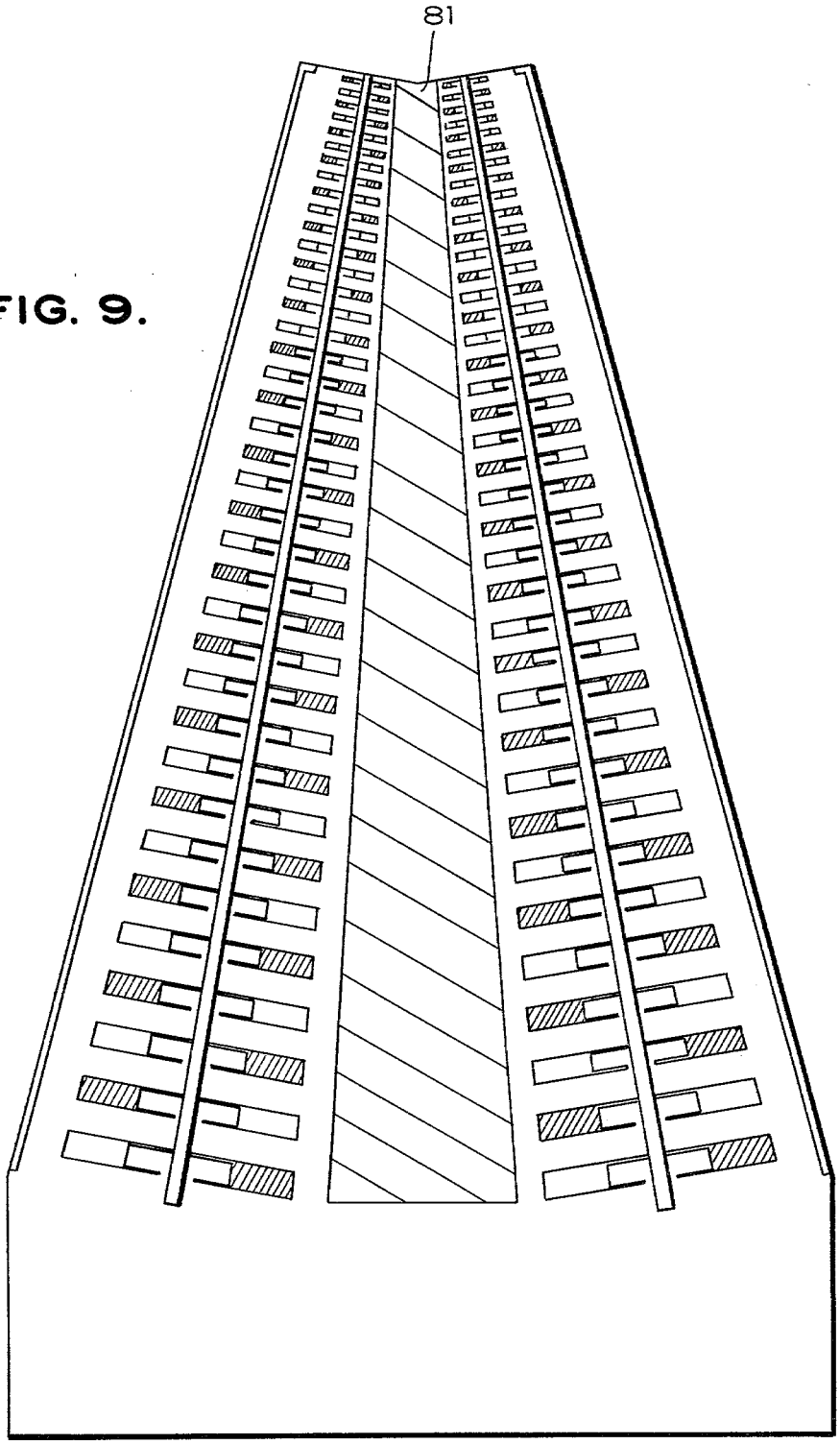
FIG. 9 illustrates a further embodiment of the array.

FIG. 9 illustrates another embodiment of the invention where excessive coupling between elements has been further received by inserting a metal film resistance card 81 between two log-periodic dipole antennas in the same plane in the area between the antennas.

Figure 10:
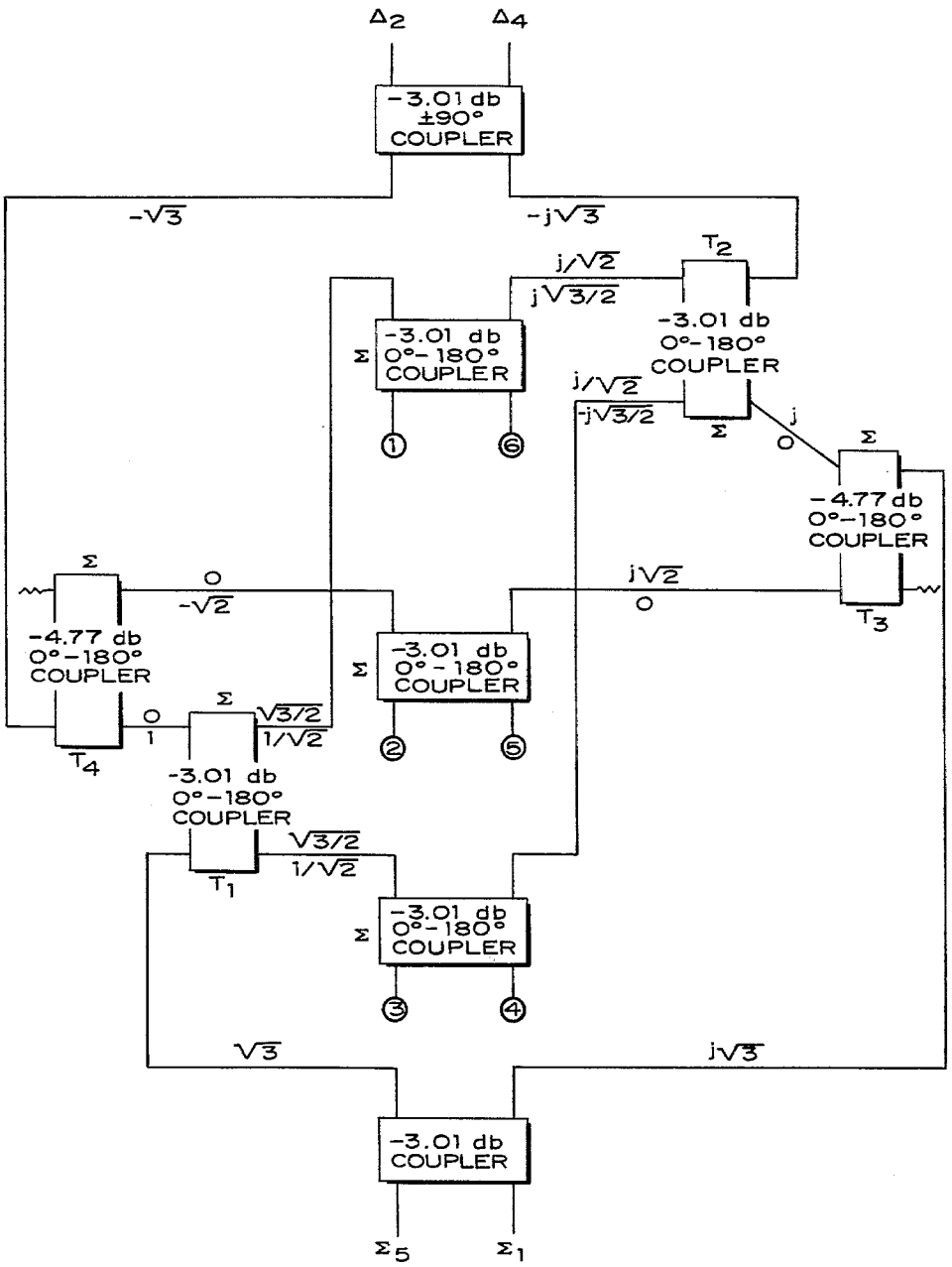
FIG. 10 is a block diagram of a six-element sum and difference feed network.

FIG. 10 is a block diagram of a conventional six element sum and difference feed network. No detailed explanation is given for the network in that any conventional feed network might be used.

The individual log-periodic dipole elements are capacitively loaded by means of the folded arms illustrated in FIG. 3 wherein the arm length corresponds to that around the periphery of the element (33 to 34). Additional capacitive loading is provided by the large metal areas on the ends of the arms corresponding to the area $\alpha \times \beta$. This results in the individual elements radiating from a region where the antenna is only 0.3 wavelengths wide as opposed to 0.5 wavelengths for a conventional unloaded log-periodic dipole.

The angle between the boresight axis of the six antennas and the centerline (feedline) of an individual antenna must be maintained so that the radiating region of the antennas lies on a circumference of approximately 1.7 wave-lengths. This "array factor" is required to achieve good left and right circular polarization characteristics from boresight to 35° off axis.

To achieve direction finding, the six antennas are phased so as to produce left and right circular sum and difference modes. To excite a left circular sum mode, the six antennas are phased with a $-60°$ phase progression between adjacent antennas with equal amplitude. To excite a right circular sum mode, the six antennas are phased with a $+60°$ phase progression between adjacent antennas with equal amplitudes. A left circular difference mode is achieved with a $-120°$ phase progression between adjacent antennas and equal amplitudes and similarly, a $+120°$ phase progression produces a right circular difference mode. Again, a network for achieving this is shown schematically in FIG. 10.

Conventional two channel monopulse operation is used to process the signals and perfect boresight can be achieved without component matching if a symmetrical feed network is employed. Direction finding in the antenna is attained by combining the left circular sum mode ($\Sigma_1$) pattern with the left circular difference mode ($\Delta_2$) pattern to form $\Sigma_1 \pm \Delta_2$. Direction finding beams in an orthogonal plane are formed by simply obtaining $\Sigma_1 \pm J\Delta_2$. $\Sigma_5 \pm \Delta_4$ can be formed by combining the right circular sum mode ($\Sigma_5$) with the right circular difference mode ($\Delta_4$).

The problem to which this antenna is addressed is the periodic sum mode gain dropout as the operating frequency is varied. This phenomena is due to the mutual coupling that occurs between the individual antennas phased array structure. A radial configuration of conventional (unloaded) log-periodic dipole, antennas suffered from excessive mutual coupling between antennas and the attendant sum mode gain dropout problem as a function of frequency. This problem has been effectively eliminated by the radial orientation and by loading the individual elements, thus increasing the physical spacing between antennas for a given array factor.

Further reductions in mutual coupling can be obtained by using loaded log-periodic dipole elements which are slightly angled forward as illustrated in FIG. 8 and/or by placing a deposited resistive film material in the phase of two opposite log-periodic dipole antennas in the area between antennas as shown in FIG. 9. The latter two techniques are useful if it is desired (depending on the specific application and pattern characteristics desired) to have an array factor corresponding to placing the phase centers of the six individual log-periodic dipole antennas on a circumference of less than 1.7 wave-lengths.

The antenna and feed network can be made using printed circuit techniques. They are etched as shown in FIG. 4 on the printed circuit board and partially slotted so that the three pairs can be interleaved to form the complete structure as shown in FIG. 5. This technique also allows close control on the alignment of opposite antennas, a critical requirement for good boresight stability.

The above described six, loaded, log-periodic dipole antenna phased array in a radial configuration offers several significant advantages over previous broadband antenna systems. The antenna has constant gain of approximately 10 db (sum mode at boresight with respect to circular isotropic) independent of operating frequency. In addition, the phase centers of the left and right circularly polarized sum and difference modes are co-incident at all frequencies, thus eliminating the need for phase compensation as a function of the off-axis angle to the target. Further, the phase center of the antenna is close to the tip or apex of the antenna at high frequencies and moves toward the base with decreasing frequency, allowing continuous broad-band operation inside a radome with reduced susceptibility to randome internal reflection. Also, the antenna has very low rear lobe gain, typically greater than 30 db below the on-axis gain. As a further factor, no relative shift between the sum and difference modes occurs as a function of frequency, thus eliminating the need for reference plane compensation. This greatly reduces network complexity, feed network loss and cost. The antenna also provides monopulse direction finding against any angle of linear polarization, left circular and right circular simultaneously. Finally the antenna allows the use of conventional two-channel monopulse processing, thus allowing zero boresight error without component amplitude or phase matching.

It is not required that the six, loaded log-periodic dipole antenna phased array in a radial configuration be constructed using printed circuit techniques or that the elements be loaded in the particular manner shown. Any conventional log-periodic dipole construction technique can be used and any loading technique such as inductive or dielectric is acceptable as long as the element is size reduced and the inner antenna mutual coupling reduced to a satisfactory value to eliminate the sum mode gain dropout problem as a function of frequency.

What is claimed is:

1. A direction finding antenna array comprising;

six planar log-periodic antennas having at least one edge and an apex;

the six antennas being physically supported such that a conical surface of revolution coincides with said at least one edge of each of the antennas;

each antenna comprising a multiplicity of uniformly loaded dipole elements;

said elements being spaced logarithmically along each antenna;

each antenna being uniformly tapered from the apex thereof to the widest portion thereof;

said loading comprising an area equal to $\alpha$ times $\beta$ where $\alpha$ = a constant multiplied by the wavelength of interest and $\beta$ equals another constant multiplied by the wavelength of interest.

2. An antenna structure as set forth in claim 1 wherein;

said dipole elements are inclined in the direction of the apex of the antenna structure.

3. A log-periodic antenna structure as set forth in claim 1 wherein;

additional loading is positioned between adjacent pairs of antennas.

4. A log-periodic antenna structure as set forth in claim 1 wherein;

pairs of antennas are printed on circuit board material;

the loaded elements comprising the dipoles are etched on said circuit board material such that corresponding parts of the dipole corresponding to the plus and minus portion of the dipole are etched on opposite sides of the circuit board material.

* * * * *